US005498010A

United States Patent [19]

Stube

[11] Patent Number: 5,498,010

[45] Date of Patent: Mar. 12, 1996

[54] EDGE BUMPER GUARD AND ROLLER WHEEL ASSEMBLY FOR ROLLABLE SUITCASE

[75] Inventor: Thomas L. Stube, Iowa Falls, Iowa

[73] Assignee: Boyt Limited Partnership, Iowa Falls, Iowa

[21] Appl. No.: 216,650

[22] Filed: Mar. 22, 1994

[51] Int. Cl.[6] ..... B62B 1/16

[52] U.S. Cl. ..... 280/37; 190/18 A

[58] Field of Search ..... 280/5.24, 37, 47.26, 280/47.33, 79.2; 190/15.1, 18 A

[56] References Cited

U.S. PATENT DOCUMENTS

| | | | |
|---|---|---|---|
| 2,478,563 | 8/1949 | Book | 190/18 A X |
| 2,581,417 | 1/1952 | Jones . | |
| 2,683,609 | 7/1954 | Altemus | 190/18 A X |
| 3,199,643 | 8/1956 | Korchmar . | |
| 3,257,120 | 6/1966 | Browning . | |
| 3,306,404 | 2/1967 | Yellin . | |
| 3,606,372 | 9/1971 | Browning . | |
| 3,861,703 | 1/1975 | Gould | 190/18 A X |
| 3,917,038 | 11/1975 | Foge et al. . | |
| 4,087,102 | 5/1978 | Sprague . | |
| 4,256,320 | 3/1981 | Hager . | |
| 4,261,447 | 4/1981 | Arias et al. . | |
| 4,411,343 | 10/1983 | Cassimally et al. . | |
| 4,616,379 | 10/1986 | Lio . | |
| 4,618,035 | 10/1986 | Mao . | |
| 4,759,431 | 7/1988 | King et al. . | |
| 4,792,025 | 12/1988 | Thomas . | |
| 4,915,402 | 4/1990 | Brinker | 280/37 |
| 4,995,487 | 2/1991 | Plath . | |
| 5,351,792 | 10/1994 | Cohen | 190/18 A |

FOREIGN PATENT DOCUMENTS

| | | | |
|---|---|---|---|
| 821263 | 12/1937 | France | 190/18 A |
| 1292341 | 3/1962 | France | 190/18 A |
| 2409720 | 6/1979 | France . | |
| 2538229 | 6/1984 | France . | |
| 3328063 | 2/1985 | Germany . | |
| 697220 | 10/1965 | Italy | 280/37 |
| 1539021 | 1/1979 | United Kingdom . | |
| 2168035 | 6/1986 | United Kingdom . | |
| 9318684 | 9/1993 | WIPO | 190/18 A |

*Primary Examiner*—Brian L. Johnson
*Attorney, Agent, or Firm*—Welsh & Katz, Ltd.

[57] ABSTRACT

An edge bumper guard assembly for a rollable suitcase luggage article is provided. The edge guard assembly has two edge guards located at the lower rear corners of the suitcase. Each of the edge guards protects a section of the lower, rear and side panels of a suitcase body forming a part of the rollable suitcase. Each of the guards also rotatably supports a wheel in close proximity to the side panels and protects the wheels from impacts with obstructions as the suitcase is being pulled along the surface. The two edge guards are interconnected by a spanning member so that the edge guards may be used on suitcase bodies having differing width dimensions.

2 Claims, 1 Drawing Sheet

FIG. 1
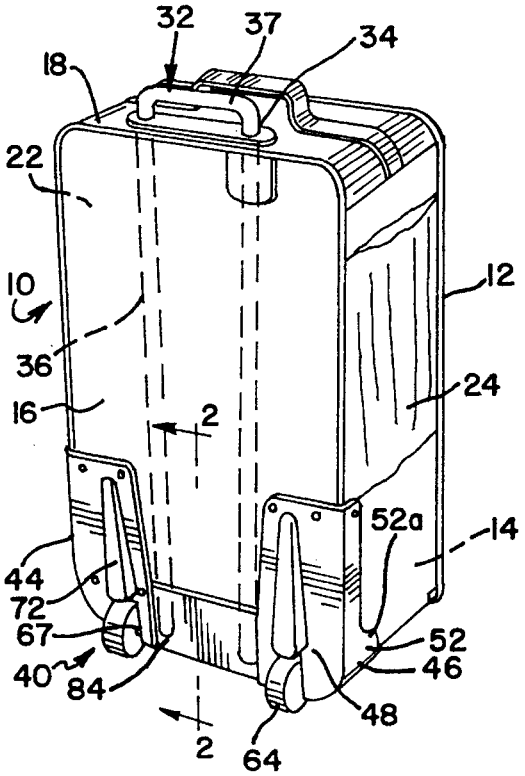
FIG. 2
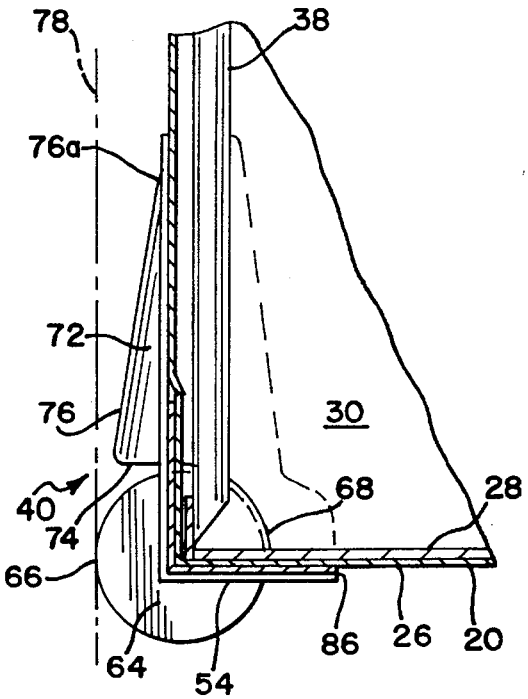
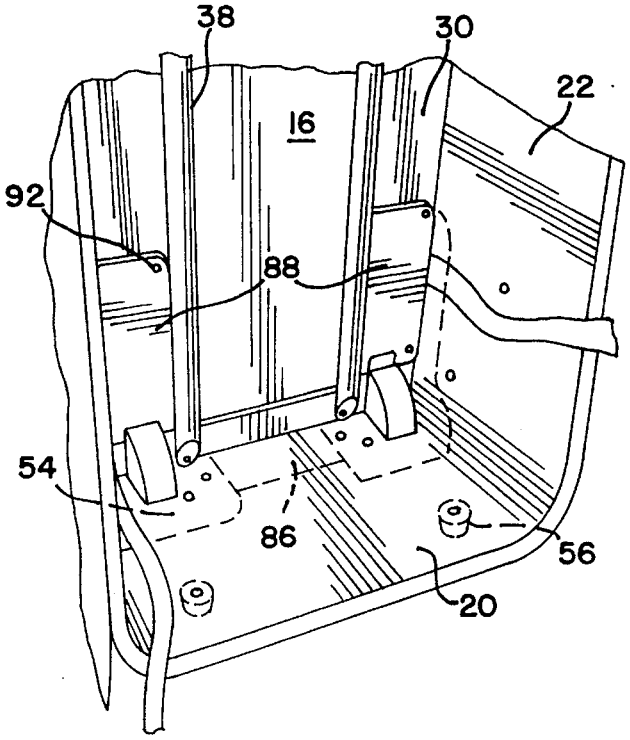
FIG. 3

EDGE BUMPER GUARD AND ROLLER WHEEL ASSEMBLY FOR ROLLABLE SUITCASE

FIELD OF THE INVENTION

This invention relates generally to portable luggage and particularly to an edge bumper guard and roller wheel assembly for roller mounted suitcases.

BACKGROUND OF THE INVENTION

In many instances, travelers must transport luggage long distances. The physical carrying of the luggage over these distances may be difficult or physically uncomfortable for many of the travelers. To facilitate the transport of luggage over long distances, luggage has been devised which includes roller wheels located generally along the lower base of the suitcase body and an extendable handle. The handle is extended and the luggage tipped over on it's edge so that the lower wheels engage the surface. The luggage may then be pulled over the distance, and the handle then retracted back into the suitcase so that the bag may be stored.

As the luggage is being pulled on the ground, the body of the luggage frequently comes into contact with obstructions such as sidewalk curbs. As the luggage body is then pulled around or upward over the obstructions, the obstructions may rub against or impact the body. This rubbing or impact may damage the suitcase body. In particular, the edges of the suitcase body around the roller wheels are scuffed and damaged by contact with the obstructions.

In addition, to increase the stability of the rollable suitcase, the roller wheels may be placed in close proximity to the outer side edges of the suitcase body. A drawback of placing the wheel in this position is the wheels are more susceptible to damage from side impacts caused by pulling the suitcase around the obstructions.

It is therefore, an object of the present invention to provide an improved roller mounted suitcase having a suitcase body which is protected against impacts by curbs or other obstructions encountered while rolling the suitcase along the surface. A related object is to provide such a suitcase having a bumper guard to protect the edges of the suitcase around the roller wheels.

Another object of the present invention is to provide an improved roller mounted suitcase body having bumper guards which absorb and deflect impact forces to minimize the effects of the forces on the roller wheels.

SUMMARY OF THE INVENTION

Accordingly an edge bumper guard assembly for a suitcase is provided. The suitcase is formed with a body composed of front and rear panels spaced from each other and interconnected by opposing top and bottom panels and opposing left side and right side panels. The edge bumper guard assembly has rigid left and right guards. Each of the guards has a side plate portion covering a portion of the side panel of the suitcase bag, a rear plate portion covering a portion of the rear panel and a bottom plate portion covering a portion of the bottom panel. Each of the left and right guards also rotatably supports a roller wheel so that a portion of the rim of the wheel extends outward from the rear and bottom plate portions of the edge guard.

The bottom and side plate portions of the bumper guard protect the roller wheels from impacts caused by dragging the suitcase body around obstructions or the like. In addition, a triangular shaped ramp extending generally vertically upward from each of the roller wheels is integrally formed with the rear plate portion of each of the guards to deflect curbs and other obstructions away from the wheels.

The edge guard assembly also has an extension guard panel extending between and fixedly connected to the left guard and the right guard to protect the suitcase body between the left and right guards. Also, by varying the length of the guard panel, the left and right guards may be employed on suitcase bodies having different widths.

BRIEF DESCRIPTION OF THE DRAWINGS

FIG. 1 is a rear perspective view of a suitcase having an edge guard of the present invention;

FIG. 2 is a partial sectional view of the suitcase of FIG. 1 taken generally along the line 2—2 and in the direction indicated; and FIG. 3 is a perspective view of the interior of the lower rear of the suitcase of FIG. 1.

DESCRIPTION OF THE PREFERRED EMBODIMENTS

Referring to FIG. 1, a suitcase including the edge guard of the present invention is generally indicated at 10. The suitcase 10 has a soft-sided suitcase body 12 which is generally rectangular in shape. The body 12 includes a generally rectangular front face panel 14 and an opposing rear face panel 16. The front face panel 14 and rear face panel 16 are interconnected and spaced from each other by a top lateral panel 18, a bottom lateral panel 20 (FIG. 2), a left side panel 22 and a right side panel 24. Referring to FIGS. 1 and 2, the top panel 18, bottom panel 20, left panel 22 and right panel 24 may be constructed with an outer layer 26 made of a cloth like material, such as nylon, and a reinforcing sheet 28 typically constructed of a semirigid plastic.

Referring to FIG. 3, the body 12 is provided with a conventional type access to access an interior compartment 30 of the body 12. Preferably a zipper (not shown) extends along three of the side edges of the front panel 14 to allow the front panel to be folded away so that the interior compartment 30 formed by the panels is exposed.

Referring back to FIG. 1, the suitcase 10 includes a retractable handle 32 which has a generally U-shaped extending member 34. The extending member 34 has a pair of coparallel tubular rods 36 attached to opposite ends of a handle 37. Each of the rods 36 are slidably received in a corresponding tubular housings 38 which generally vertically extend within the interior compartment 30 of the body 12 as shown in FIG. 3.

Referring to FIGS. 1 and 2, an edge bumper guard of the present invention is generally indicated at 40. The guard 40 includes a left guard member 44 and a complementary right guard member 46. The left guard 44 is configured to mirror the shape of the right guard 46. Each of the guard members 44 and 46 include a rear plate portion 48 which covers the lower corner sections of the rear panel 16 of the suitcase body 12. The rear portion 48 is joined to a side plate portion 52 which extends along and covers a lower rear corner section of the corresponding right panel 24 and left panel 22. The lower edge of the rear portion 48 and lower edge of the side portion 52 are joined to a bottom plate portion 54 which extends along a rear corner section of the bottom panel 20.

Both the left guard 44 and right guard 46 rotatably support a roller wheel 64 so that a portion of the rim 66 of the wheel extends outward from the bottom portion 54 and rear portion 48 of the respective guard. Each of the roller wheels is rotatably mounted to an axle 67 extending within a housing 68 formed in the left and right guards 44 and 46. The placement of the axle 67 within the housings 68 and extending a portion of the rim outward from the guards 44, 46 reduces the size of the exterior profile of the wheel to protect the wheels 64 from impact.

To roll the suitcase 10 along the surface, the handle 30 is extended and the body 12 is tilted rearward. The handle may include a locking feature (not shown) to lock the handle in the extended position. By pushing and pulling on the handle 30, the suitcase 10 may be maneuvered along the surface and also over and around obstructions such as street curbs. The suitcase 10 also includes a couple of foot stubs 56 which are attached to the bottom panel 20 to provide support and stability to the suitcase body 12 when the suitcase body is placed in the upright position.

The left and right guards 44, 46 are dimensioned and shaped to protect the suitcase body 12 against those obstructions typically encountered while maneuvering the suitcase body 12. To protect against the impact of curbs, the rear portion 48 and edge portion 52 of the guards extend along the suitcase body 12, upward from the bottom portion, preferably 6–12 inches. The side portion 52 has a lower wide section **52*a* to provide extra protection to the side panels 22, 24** at the lower rear corner of the side panels.

The housings 68 for the roller wheels 64 and the roller wheels are located in close proximity to the side portions 52 to increase the stability of the suitcase body 12 as the suitcase is pulled along the surface. To protect the wheels 64, the side plate portions 52 and the bottom plate portions deflect and absorb the impact of obstructions which may contact the suitcase 10 as the suitcase is pulled.

Each of the wheels 64 is also protected by a ramp 72 which extends upward along the rear portion 48 of the guards vertically above the housings 68. The ramps 72 are preferably integrally attached to the rear portions 48. Referring to FIG. 2, the ramps 72 have a cross-sectional profile in the shape of a triangle with the base 74 of the ramp disposed in close proximity to the housing 68. An outer ramping surface 76 is angled outward from an upper tip **76*a*. To protect the wheel 64, the ramping surface 76 and base 74 are joined at a point which is in close proximity to an imaginary line 78 parallel to the rear panel 16 and tangent to the rim 66** of the wheel.

To allow similarly sized left guards 44 and right guards 46 to be attached to suitcase bodies 12 having front and rear panels 14, 16 of different widths, the edge guard 40 includes a separate extension or spanning member 82 which protects the rear panel and bottom panel 20 between the left guard 44 and right guard 46. The spanning member 82 is separately formed from but rigidly attached to the left and right edge guards. The spanning member 82 includes a planar rear section 84 which extends along the lower edge section of the rear panel 16 between the rear portion 48 of the left and right edge guards 44, 46. The spanning member 82 also includes a planar bottom section 86 which extends along the rear edge section of the bottom panel 20 between the bottom portion 54 of the left and right edge guards 44, 46.

The side portion 52 and bottom portion 54 of the left guard and right guard 44, 46 are fixedly attached to the reinforcing sheets 28 in the side panels 22, 24 and bottom panel 20 respectively. However, the rear panel 16 typically does not have a reinforcing sheet. Therefore, to provide a rigid backing to the rear portions 48 of the left guard 44 and right guard 46, the edge guard 40 includes backing panels 88 which extend upward along the interior surface of the rear panel in general alignment with the rear portions. The rear portions 48 of the left guard 44 and right guard 46 are preferably rigidly attached to the corresponding backing panel 88 by rivets 92.

Thus, an edge bumper guard assembly for a rollable suitcase luggage article is provided. The guard assembly has two guards located at the lower rear corners of the suitcase. Each of the edge guards protects a section of the lower, rear and side panels of a suitcase body forming a part of the rollable suitcase. Each of the guards also includes a roller wheel located in close proximity to the side panels of the suitcase body to increase the stability of the body. The configuration of the edge guards protects the roller wheels from damage by deflecting and absorbing contacts between the suitcase and surface obstructions. The two edge guards are interconnected by a spanning member so that the edge guards may be used on suitcase bodies having differing width dimensions.

A specific embodiment of the novel edge guard for a rollable suitcase according to the present invention has been described for the purposes of illustrating the manner in which the invention may be made and used. It should be understood that implementation of other variations and modifications of the invention in its various aspects will be apparent to those skilled the art, and that the invention is not limited by the specific embodiment described. It is therefore contemplated to cover by the present invention any and all modifications, variations, or equivalents that fall within the true spirit and scope of the basic underlying principles disclosed and claimed herein.

What is claimed is:

1. An edge bumper guard assembly for a rollable suitcase to protect the suitcase from damage by contact with obstructions as the suitcase is rolled along a surface, the suitcase having a body with front and rear panels spaced from each other and interconnected by opposing top and bottom panels and opposing left side and right side panels, the assembly comprising:

a rigid left guard having, a rear plate portion extending about a portion of the rear panel, a left wheel rotatably mounted to said rear plate portion in close proximity to the left panel, said left wheel having an outer rim, a left plate portion extending about a portion of the left panel to protect said left wheel from impacts with the obstructions, a portion of said outer rim of said left wheel extending outward from said rear plate portion, a bottom plate portion integrally attached to said left plate portion and said rear plate portion of said left guard, said bottom plate portion extending about a portion of said bottom panel, and a triangular shaped ramp attached to said rear plate portion and extending generally vertically upward from said left wheel, said triangular shaped ramp having a base and ramping surface, said base and ramping surface joined at a ramp edge, wherein said outer rim of said left wheel protrudes beyond said ramp edge;

a rigid right guard having, a rear plate portion extending about a portion of the rear panel, a right wheel rotatably mounted to said rear plate portion in close proximity to the right panel, said right wheel having an outer rim, a right plate portion extending about a portion of the right panel to protect said right wheel from impacts with the obstructions, a portion of said outer rim of said right wheel extending outward from said rear plate portion, a bottom plate portion integrally attached to said right plate portion and said rear plate portion of said right guard, said bottom plate portion extending about a portion of said bottom panel, and a triangular shaped ramp attached to said rear plate portion and extending generally vertically upward from said right wheel, said triangular shaped ramp having a base and ramping surface, said base and ramping surface joined at a ramp edge, wherein said outer rim of said right wheel protrudes beyond said ramp edge; and an extension guard panel separately formed from, but extending between and fixedly connected to said left guard and said right guard, said extension guard panel includes a generally planar rear portion which extends between and is rigidly connected to said rear plate portion of said left guard and said rear plate portion of said right guard, whereby said left guard and said right guard can be adjusted to fit suitcases of various widths.

2. The guard assembly of claim 1 further comprising at least two backing panels extending along an interior surface of only the rear panel of the suitcase body, one said backing panel rigidly attached to said rear plate portion of said right guard and said other backing panel rigidly attached to said rear plate portion of said left guard.

* * * * *